US005334263A

United States Patent [19]

Schaeffer

[11] Patent Number: 5,334,263

[45] Date of Patent: Aug. 2, 1994

[54] SUBSTRATE STABILIZATION OF DIFFUSION ALUMINIDE COATED NICKEL-BASED SUPERALLOYS

[75] Inventor: Jon C. Schaeffer, Milford, Ohio

[73] Assignee: General Electric Company, Cincinnati, Ohio

[21] Appl. No.: 802,683

[22] Filed: Dec. 5, 1991

[51] Int. Cl.[5] ..... C23C 8/34

[52] U.S. Cl. ..... 148/217; 148/220; 148/316; 148/901; 148/902; 416/241 R; 428/610

[58] Field of Search ..... 148/217, 316, 901, 902, 148/220; 416/241 R; 428/610, 627, 628, 652, 941; 415/200

[56] References Cited

U.S. PATENT DOCUMENTS

| | | | |
|---|---|---|---|
| 2,763,584 | 9/1956 | Badger | 148/32 |
| 2,898,251 | 8/1959 | Treder et al. | 148/6.35 |
| 3,010,856 | 11/1961 | Seelig et al. | 148/6 |
| 3,257,230 | 6/1966 | Watchell et al. | 428/941 |
| 3,290,126 | 12/1966 | Monson | 428/610 |
| 3,415,672 | 12/1968 | Levinstein et al. | 117/71 |
| 3,540,878 | 11/1970 | Levine et al. | 148/421 |
| 3,594,219 | 7/1971 | Maxwell et al. | 117/131 |
| 3,764,279 | 10/1973 | Kmieciak et al. | 29/194 |
| 3,922,182 | 11/1975 | Merrick | 148/410 |
| 3,951,642 | 4/1976 | Chang et al. | 75/255 |
| 3,961,910 | 6/1976 | Baladjanian et al. | 428/938 |
| 3,979,534 | 9/1976 | Rairden | 427/405 |
| 4,071,638 | 1/1978 | Chang et al. | 427/192 |
| 4,084,025 | 4/1978 | Rairden | 428/652 |
| 4,117,179 | 9/1978 | Jackson et al. | 428/652 |
| 4,260,654 | 4/1981 | Baldi | 427/253 |
| 4,439,470 | 3/1984 | Sievers | 427/252 |
| 4,761,346 | 8/1988 | Naik | 428/627 |
| 4,933,239 | 6/1990 | Olson et al. | 428/652 |
| 4,962,005 | 10/1990 | Alperine et al. | 428/670 |

FOREIGN PATENT DOCUMENTS 03061345 3/1991 Japan .

*Primary Examiner*—R. Dean
*Assistant Examiner*—Margery S. Phipps
*Attorney, Agent, or Firm*—Jerome C. Squillaro; Carmen Santa Maria

[57] ABSTRACT

A superalloy article has a nickel-based superalloy substrate containing TCP-phase forming elements such as rhenium, chromium, tantalum and tungsten. A carbide precipitate-containing region is formed within the substrate extending to a carbide depth below a surface of the substrate, preferably by depositing carbon on the surface of the substrate and diffusing the carbon into the substrate. An aluminum-rich diffusion layer extends from the surface of the substrate to an aluminide depth below the surface of the substrate. Preferably, the carbide depth is about the same as the aluminide depth. The presence of the carbide precipitates inhibits the formation of the deleterious TCP-phase.

18 Claims, 2 Drawing Sheets

SUBSTRATE STABILIZATION OF DIFFUSION ALUMINIDE COATED NICKEL-BASED SUPERALLOYS

BACKGROUND OF THE INVENTION

This invention relates to nickel-based superalloys, and, more particularly, to such alloys that are coated with aluminide coatings to enhance their resistance to environmentally induced degradation.

In an aircraft gas turbine (jet) engine, air is drawn into the front of the engine, compressed by a compressor, and mixed with fuel. The compressed mixture is burned in a combustor, and the hot combustion gases flow through a turbine that turns the compressor. The hot gases then flow from the rear of the engine.

The turbine includes stationary turbine vanes that deflect the hot gas flow sideways, and turbine blades mounted on a turbine Wheel that turns as a result of the impingement of the hot gas stream. The turbine vanes and blades experience extreme conditions of high temperature, thermal cycling when the engine is turned on and off, oxidation, corrosion, and, in the case of the turbine blades, high stress and fatigue loadings. The higher the temperature of the hot combustion gas, the greater the efficiency of the engine. There is therefore an incentive to push the materials of the engine to ever-higher temperatures and loadings.

Nickel-based superalloys are widely used as the materials of construction of gas turbine blades and vanes. These superalloys contain primarily nickel, and a variety of alloying elements such as cobalt, chromium, tungsten, aluminum, tantalum, rhenium, hafnium, and others in varying amounts carefully selected to provide good mechanical properties and physical characteristics over the extremes of operating conditions experienced by the engine.

In designing alloys for use in turbine components, it has been observed that no single superalloy discovered to date has an optimal combination of good mechanical properties and good resistance to environmental damage such as oxidation and high-temperature corrosion. The primary approach that has evolved as a result of this observation is to utilize as the basic structure of the turbine blade or vane a superalloy having good mechanical properties, and to coat the superalloy with an environmentally resistant coating of another material to protect the blade or vane from oxidation and corrosion damage.

One type of coating is an aluminide coating. Aluminum is diffused into the surface of the nickel-based superalloy article to form a nickel-aluminide layer, which then oxidizes to form an aluminum oxide surface coating during treatment or in service. (Optionally, platinum may also be diffused into the surface. ) The aluminum oxide surface coating renders the coated article more resistant to oxidation and corrosion, desirably without impairing its mechanical properties. Aluminide coating of turbine blades and vanes is well known and widely practiced in the industry, and is described, for example, in U.S. Pat. Nos. 3,415,672 and 3,540,878.

Recently it has been observed that, when some advanced nickel-based superalloys are coated with an aluminide coating and then exposed to service or simulated-service conditions, a secondary reaction zone (SRZ) forms in the underlying superalloy. This SRZ region is observed at a depth of from about 50 to about 250 micrometers (about 0.002–0.010 inches) below the original superalloy surface that has received the aluminide coating. The presence of the SRZ reduces the mechanical properties in the affected region, because the material in the SRZ appears to be brittle and weak.

The formation of the SRZ is a major problem in some types of turbine components, because there are cooling channels located about 750 micrometers (about 0.030 inches) below the surface of the article. Cooling air is forced through the channels during operation of the engine, to cool the structure. If the SRZ forms in the region between the surface and the cooling channel, it significantly weakens that region and can lead to reduced strength and fatigue resistance of the article.

To date, there has been proposed no approach for avoiding the formation of, or reducing the adverse effects of, the secondary reaction zone. There is a need for such a solution to the SRZ problem, in order to permit the affected superalloys to be used in gas turbine blades and vanes over extended service lives when the SRZ can form. The present invention fulfills this need, and further provides related advantages.

SUMMARY OF THE INVENTION

The present invention provides an approach for avoiding the formation of the secondary reaction zone in advanced high-temperature superalloys. It can be implemented without changing the gross composition of the superalloy. The alloy can therefore be selected for optimum performance, and then processed to stabilize its surface regions against formation of the SRZ. The processing required for the stabilization adds a step to the preparation of the articles, but can be accomplished in large batch processing so that the added cost is small.

It has now been discovered that the SRZ contains a topologically close packed (TCP) phase such as the phase termed "P-phase" found in some alloys, which is similar to the better-known sigma phase and formed during elevated temperature exposure in the aluminum-rich environment of the near-surface aluminided region. Refractory elements preferentially form TCP phases such as P-phase. These are most notably rhenium, chromium, and tungsten. The incidence of TCP-phases can be reduced by increasing the carbon content of the subsurface region of the superalloy, reducing the availability of TCP-phase forming elements and thereby stabilizing the structure against formation of this phase.

In accordance with the invention, a superalloy article comprises a nickel-based superalloy substrate containing TCP-phase forming elements. The article further includes a carbide precipitate-containing region within the substrate and extending to a carbide depth below a surface of the substrate. Overlying the substrate is an aluminum-rich diffusion layer extending from the surface of the substrate to an aluminide depth below the surface of the substrate, the carbide depth being at least as great as the aluminide depth. More specifically, a superalloy article comprises a nickel-based superalloy substrate containing refractory elements, such as rhenium, chromium, tungsten and combinations thereof, and a carbide precipitate-containing region within the substrate and adjacent to a surface of the substrate.

The TCP phase, such as the P-phase observed in some alloys, is precipitated in an aluminum-rich region near the surface of the superalloy following the aluminizing treatment. A fairly high content of rhenium and tungsten are required for the TCP phase such as P-phase to form. Only certain nickel-based superalloys have sufficiently high contents of these elements to be susceptible to TCP-phase formation, and in particular certain advanced nickel-based superalloys such as Rene 162, described in detail in copending, commonly assigned U.S. Pat. No. 5,151,249, incorporated herein by reference, have been found susceptible to TCP P-phase formation.

In the present approach, the local composition of the near-surface region of the superalloy is altered to reduce the amount of TCP-phase forming elements available for detrimental phase formation. The most effective approach is to react the TCP-phase forming elements with carbon to form carbides, thereby reducing the available amount of the TCP-phase forming elements. That is, providing carbon at the surface of the superalloy results in the precipitation of carbides rich in the TCP-phase-forming elements, primarily rhenium, tantalum and tungsten. These elements are therefore no longer available to form TCP-phase, and it is suppressed. Stated alternatively, the near-surface regions of the aluminided superalloy are stabilized against formation of the TCP-phase.

More generally, then, a superalloy article comprises a nickel-based superalloy substrate susceptible to the formation of a secondary reaction zone during aluminiding treatments, the substrate being depleted of available TCP-phase forming elements to a depleted depth below a surface of the substrate. That is, the TCP-phase elements are still present, but in a stable reacted state, such as a carbide, in which they are not available to form TCP-phases during extended exposure. Overlying the substrate is an aluminum-rich diffusion layer extending to an aluminide depth below the surface of the substrate, the depleted depth, in which the TCP-phase forming elements are tied up and unavailable for TCP phase-formation, being at least as great as the aluminide depth.

The present invention also provides a preferred method for accomplishing the stabilization of the near-surface region of the superalloy against the formation of the deleterious region. In accordance with this aspect of the invention, a process for preparing a coated article comprises the steps of furnishing a nickel-based superalloy substrate containing rhenium, chromium, tungsten, and optionally other refractory elements, depositing a carbon-containing layer, preferably formed of pure carbon, over a surface of the substrate; and diffusing carbon from the carbon-containing layer into the substrate at a temperature sufficient to form carbide precipitates in the substrate. After the carbides are formed, there follow the steps of depositing an aluminide coating on the surface of the substrate, and heating the substrate to form a protective layer containing aluminum and nickel at the surface of the substrate. The step of depositing a carbon-containing layer can be accomplished by any acceptable method, such as chemical vapor deposition from a carbon-containing gaseous phase.

Desirably, the time and temperature profile in the step of diffusion is adjusted so that the carbide precipitates extend to a depth below the surface of the substrate at least as great as the penetration depth of the aluminum-enriched zone below the surface that is produced by the depositing and heating steps. These parameters can be determined by initial experiments to ascertain the diffusion parameters. Optionally, a layer of platinum or other noble metal such as rhodium or palladium may be deposited on the surface of the substrate after the step of diffusion and before the step of depositing an aluminide coating.

The present approach provides an important advance in the art of utilizing certain advanced superalloys in high-temperature applications, that are to be protected with an aluminiding surface treatment. Other advantages of the invention will be apparent from the following more detailed description of the preferred embodiments, taken in conjunction with the accompanying drawings, which illustrate, by way of example, the principles of the invention.

DETAILED DESCRIPTION OF THE PREFERRED EMBODIMENTS

Figure 1:
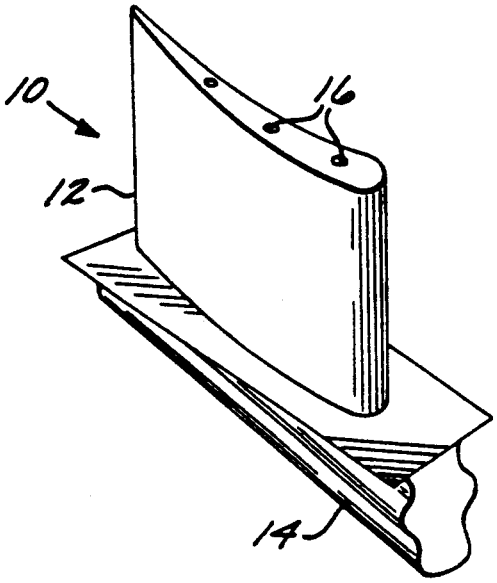
FIG. 1 is a perspective view of a superalloy article.

The stabilization approach of the invention is used with nickel-based superalloys, in applications such as a jet engine gas turbine blade 10 illustrated in FIG. 1 (or equivalently, with a gas turbine vane). The blade may be formed of any nickel-based superalloy that has a tendency to form a sub-surface secondary reaction zone during and after an aluminiding treatment. An example of such a nickel-based superalloy is Rene 162, which has a composition in weight percent of about 12.5 percent cobalt, 4.5 percent chromium, 6.25 percent rhenium, 7 percent tantalum, 5.74 percent tungsten, 6.25 percent aluminum, 0.15 percent hafnium, 0.5 percent yttrium, minor amounts of other elements, and balance nickel.

The blade 10 includes an airfoil section 12 against which hot combustion gases are directed when the engine operates, and whose surface is subjected to severe oxidation and corrosion attack during service. The airfoil section 12 is anchored to a turbine disk (not shown) through a dovetail or root section 14. In some cases, cooling passages 16 are present in the airfoil section 12, through which cool bleed air is forced to remove heat from the blade 10. The blade is normally prepared by a casting and solidification procedure well known to those skilled in the art, such as investment casting, directional solidification, or single crystal growth.

Figure 2:
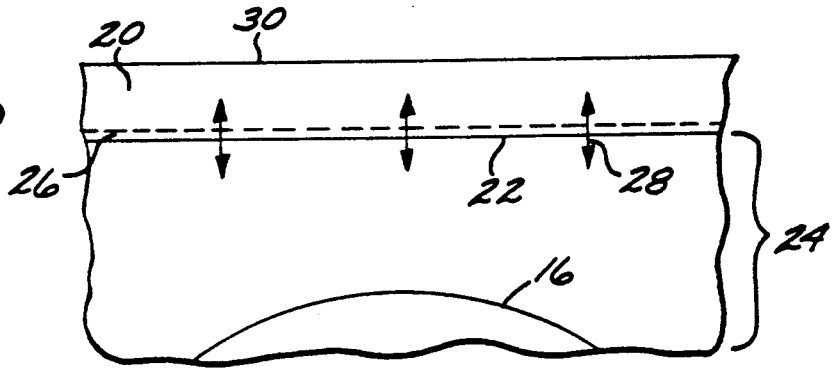
FIG. 2 is a schematic sectional view of the article of FIG. 1 taken generally along line 2—2, illustrating the near-surface region during a diffusional platinum-aluminiding treatment when the treatment of the present invention is not used.
Figure 3:
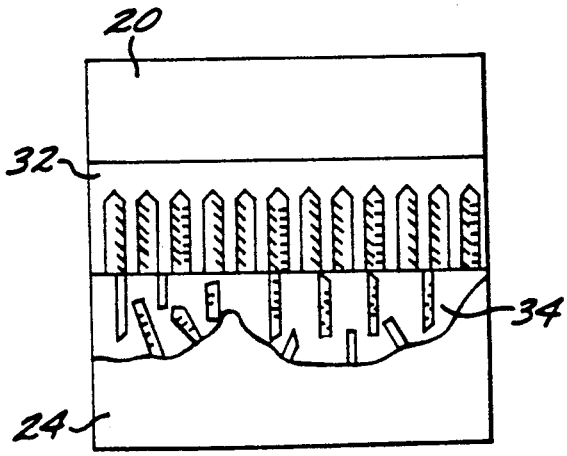
FIG. 3 is an enlarged, diagrammatic sectional view of the microstructure near the surface in the region depicted in FIG. 2.

FIGS. 2 and 3 are sections through the blade 10 showing the result of a conventional aluminiding treatment. An aluminum-containing layer 20 is formed on a surface 22 of the airfoil section 12, which acts as a substrate 24. Optionally, in some cases a thin layer of a noble metal, such as the platinum-containing layer 26, may be deposited on the surface 22 prior to deposition of the aluminum-containing layer 20. After application of layer 20 over surface 22, the blade 10 is heated to elevated temperature so that there is interdiffusion between the layer 20 (and optional layer 26) and the substrate 24, indicated generally by the arrows 28. The type, amount, and extent of the interdiffusion are not critical to the operability of the present invention, but depend upon a number of factors such as time, temperature, substrate alloy, and activity of the aluminum source. Either during or after this process, an upper surface 30 is allowed to oxidize, forming an aluminum oxide layer (not shown).

FIG. 3 depicts the metallurgical microstructure that results from the interdiffusion process just described. Two types of diffusion zones are produced. A primary diffusion zone 32 containing sigma phase in a beta or beta-prime matrix is formed just below the layer 20. Additionally, a secondary reaction zone (SRZ) 34 forms between the primary diffusion zone 32 and the substrate 24. The SRZ 34 has been determined to result in reduced mechanical properties of the blade 10, particularly when it occupies a substantial fraction of the material between the surface 22 and the subsurface cooling passage 16 (FIG. 2).

Metallurgical studies have shown that the SRZ contains an accicular topologically close packed (TCP) phase that, in the case of the Rene 162 alloy, has been termed P-phase, in a matrix of gamma plus gamma-prime. The gamma plus gamma-prime matrix is desirably present, but the TCP-phase is undesirable. The presence of TCP phase generally, or a particular variant of the TCP phase such as the P-phase of Rene 162 alloy, leads to undesirable mechanical properties and long-term metallurgical instability of the article made of an alloy that is susceptible to formation of the secondary reaction zone. The present approach removes or reduces the amount of the TCP-phase.

The TCP-type P-phase of Rene 162 alloy has been chemically microanalyzed, and has been found to be rich in rhenium, chromium, and tungsten. A semi-quantitative analysis has shown that the P-phase of the Rene 162 alloy in the SRZ has a composition of approximately 50 percent rhenium, 15 percent tungsten, 15 percent nickel, 10 percent cobalt, 9 percent chromium, balance minor elements (percentages in weight percent). The precise composition is not significant. However, it is important that the TCP-phase contains such high rhenium, chromium, and tungsten contents as compared with the overall composition of the superalloy in these elements, which is about 6.25 percent rhenium, 4.5 percent chromium, and 5.75 percent tungsten in the case of Rene 162.

Many past and current superalloys do not use such high rhenium and tungsten contents as found in Rene 162 and some other superalloys of current interest. The SRZ phenomena is not observed in these other alloys, confirming the hypothesis that the TCP-phase forms in aluminum-rich surface regions (such as produced by the aluminiding treatment) of superalloys having high rhenium and tungsten contents, and typically also having a high chromium content. The present approach therefore acts to reduce the amount of available refractory element reactants, such as rhenium, chromium, tantalum and tungsten, that are available to form TCP-phases in the near-surface, aluminum-rich regions by tying these reactants up in stable compounds, while not reducing the rhenium, chromium, and tungsten contents in other regions remote from the surface.

Figure 4:
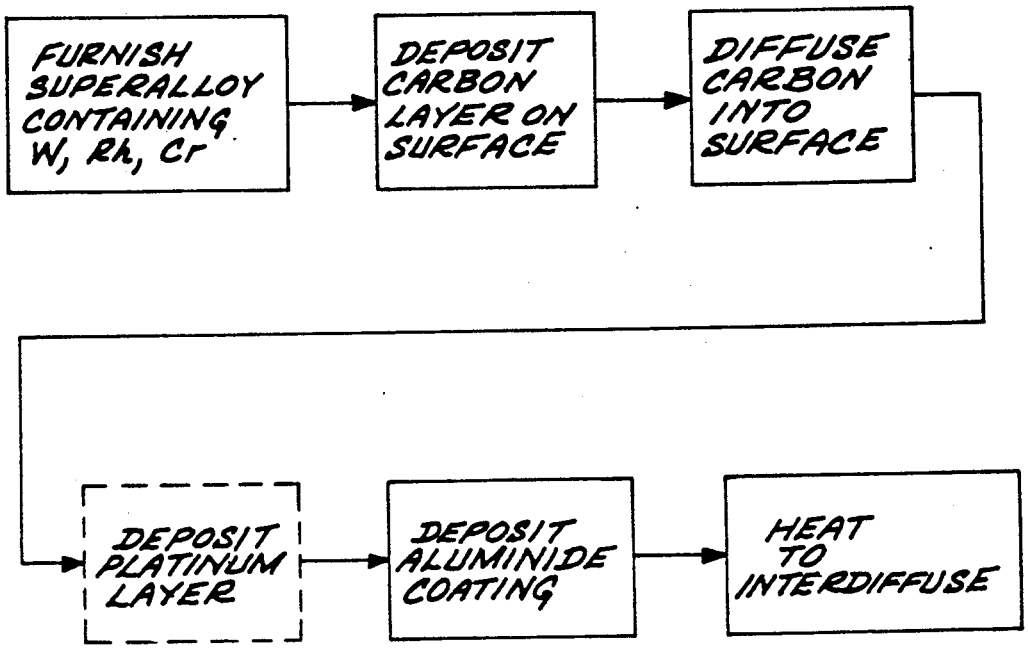
FIG. 4 is a process flow chart for the treatment of the invention.

A preferred process for reducing the amount of available refractory element reactants, such as rhenium, chromium, and tungsten that would otherwise form the TCP-phase is depicted in FIG. 4. A superalloy article made of a material such as Rene 162, containing rhenium, chromium, tantalum and tungsten, is provided. This alloy would form the P-phase, one type of TCP-phase, following the aluminiding process, unless processed to avoid such TCP-phase formation. A layer of carbon is deposited on the surface of the article. Prior to deposition of the carbon, the surface is carefully cleaned, preferably first by grit blasting to remove any oxide and then with an alkaline or solvent cleaner to remove dirt, so that the carbon can diffuse into the surface of the substrate.

The carbon layer may be deposited by any operable technique. Chemical vapor deposition from a carbon-containing gas such as a methane-hydrogen mixture at elevated temperature is preferred, because all exposed surfaces (except those intentionally masked) can be coated without line-of-sight access from a source. In the preferred approach, deposition is at about 2100° F. for 15–60 minutes, to produce a layer of carbon that is about 1–5 micrometers (about 0.00004–0.0002 inches) thick. The carbon is preferably deposited before the diffusion coating is deposited, so that the carbon does not have to diffuse through the coating to reach the substrate. The carbon diffuses into the substrate during the deposition period, and later during the aluminiding treatment and subsequent exposure. If necessary, additional diffusion treatments can also be used. After the introduction of carbon is complete, any residual carbon is removed from the surface, preferably by grit blasting.

The diffusion coating is then deposited. If the coating is to be a platinum aluminide coating, a layer of platinum about 5 microns in thickness is deposited on the surface by any operable method, such as electroplating. (This optional step is indicated by a dashed process step box in FIG. 4.) The aluminum-containing layer 20 is deposited onto the surface 22, or overlying the platinum coating if one was provided. The aluminum-containing layer 20 may be deposited by any operable process, such as deposition of aluminum or an aluminum alloy from the vapor phase or by chemical vapor deposition, which are well known in the art. Another approach for depositing the aluminide coating is pack cementation. This process is disclosed in U.S. Pat. Nos. 3,415,672 and 3,540,878, whose disclosures are incorporated herein by reference. Briefly, the substrate prepared in the manner described is packed in a bed made of a mixture of an inert powder, such as aluminum oxide, as aluminum source alloy such as described in the '878 patent, and an activator such as ammonium chloride or ammonium fluoride. A preferred source alloy has a composition of 50 to 70 weight percent titanium, 20–48 weight percent aluminum, and 0.5–9 percent carbon. During deposition, or after the aluminum-containing layer has been deposited, the coated substrate is heated to a temperature in excess of 1800° F. for a time that is typically about 240 minutes or more, so that aluminum from the layer 20 and elements from the substrate 24 interdiffuse to form the aluminide coating. The aluminide coating is preferably about 50–75 micrometers (about 0.002–0.003 inches) in thickness.

Figure 5:
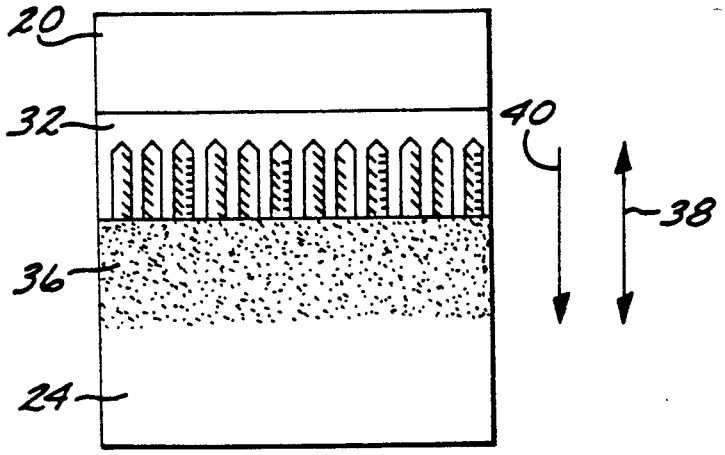
FIG. 5 is an enlarged, diagrammatic sectional view of the microstructure near the surface of an article like that depicted in FIGS. 1-3, except that the process treatment of FIG. 4 has been utilized.

FIG. 5 illustrates the microstructure of the near-surface region of the blade 10 when the approach of the invention, just described in relation to FIG. 4, is followed. The structure is similar to that of FIG. 3, but no TCP-phase (e.g., P-phase) is present and therefore no secondary reaction zone is present. Instead, an array of fine carbon-rich precipitates (carbides) 36 are present in the region to which the deposited carbon atoms have diffused in sufficient quantity to form carbides. These carbides typically contain refractory elements, such as rhenium, chromium, tantalum and tungsten, reducing the amount of these elements available to react to form TCP-phase in a depleted region 38, which may equivalently be described as a carbide-precipitate region. The term "depleted region" means that the concentration of TCP-phase forming elements in a form suitable for reacting to form TCP-phase is reduced. The term should not be taken to mean that those elements have been completely removed from the depleted region 38. Instead, the TCP-phase forming elements such as rhenium, chromium, tantalum and tungsten are present but in a reacted form such that they cannot form TCP-phase.

Aluminum diffuses from the layer 20 into the substrate to an extent indicated by an aluminide depth 40. The depleted region 38 extends to a depth which is preferably approximately equal to the aluminide depth 40, but may be slightly greater than or less than the aluminide depth 40. The depleted region 38 extends to a depth of from about 25 to about 100 micrometers below the surface of the substrate, and the aluminide layer 40 extends to a depth of from about 25 to about 50 micrometers below the surface of the substrate. If the depleted region 38 is substantially greater than the aluminide depth 40, the excess volume of material is unnecessarily depleted of the solid-solution strengthening elements rhenium, chromium, and tungsten and includes unnecessary carbide precipitates. The carbide precipitates may cause premature failure of the superalloy if the depth of the region 38 is too great. If the depleted region 38 is substantially less than the aluminide depth 40, there will be a small region where the TCP-phase may form. The result is a secondary reaction zone that is smaller than would otherwise be present, but is still there and is still detrimental.

By way of illustration of the considerations involved, the depth of a platinum-aluminide primary diffusion zone 32 is typically about 30 micrometers (about 0.001 inches). Diffusion theory predicts that the depth of penetration of the carbon during diffusion is about $(2\ Dt)^{0.5}$, where D is the interdiffusion coefficient at a selected treatment temperature (about $6\times10^{-9}cm^2/sec$ at 2100° F.) and t is time. According to this calculation, the carburization treatment must be at least 12½ minutes to have an effect on SRZ formation. A similar calculation can be performed for other conditions. The calculations are verified by experimental studies in each case to establish that the SRZ is not present, and that the carbon diffusion depth is no greater than necessary.

The carburization of the near-surface regions of ferrous alloys such as steel is a well-established procedure to impart increased hardness to the surface. However, it is standard practice not to carburize or otherwise introduce high carbon contents into the near-surface regions of nickel-base superalloys. Excessive carbon in the near-surface region of nickel-base superalloys reduces the oxidation and corrosion resistance of the alloys, and leads to premature failures. Thus, the present approach of carburizing or carbiding the surface for a particular purpose, to avoid the formation of the SRZ, represents a significant departure from the conventional approach in this field.

The approach of the present invention has been verified with experimental studies. Specimens of Rene 162 alloy were provided. Some were given the preferred carbon treatment of the invention, as discussed previously, by depositing carbon at about 2100° F. for about 15–60 minutes from a methane-hydrogen gas mixture. All of the specimens were then provided with a platinum-aluminide treatment, as described previously. (The residual carbon layer was removed by grit blasting prior to electroplating the platinum layer onto the surface.) The platinum layer was typically about 5 micrometers (0.0002–0.0006 in.) thick, and the aluminum layer was about 65–75 (about 0.0025–0.003 in.) micrometers thick. The pack aluminiding was performed as previously described, at a temperature of about 1975° F. for about 4 hours.

After the aluminide coating was applied, specimens of each type were heated to a temperature of about 2050° F. in air for about 50 hours. Such a treatment would produce a SRZ, if it were to form. The specimens without the carbon-diffusion treatment of the invention exhibited an extensive SRZ with the P-phase, but none was found in the specimens that were given the carbon-diffusion treatment. These carbon-treated specimens had fine carbides of a size of about 0.5 micrometers near the surface. The carbides became slightly coarser with increasing depth.

The present invention provides an improved structure to nickel-base superalloys that would otherwise be susceptible to formation of a secondary reaction zone. Such superalloys with aluminide, platinum (or other noble metal)-aluminide, and overlay coatings benefit from the approach of the invention. Although a particular embodiment of the invention has been described in detail for purposes of illustration, various modifications may be made without departing from the spirit and scope of the invention. Accordingly, the invention is not to be limited except as by the appended claims.

What is claimed is:

1. A superalloy article, comprising:

a nickel-based superalloy substrate containing TCP-phase forming elements;

a carbide precipitate-containing region within the substrate and extending to a carbide depth below a surface of the substrate; and an aluminum-rich diffusion layer extending from the surface of the substrate to an aluminide depth below the surface of the substrate.

2. A superalloy article, comprising:

a nickel-based superalloy substrate containing refractory elements selected from the group consisting of rhenium, chromium, tantalum, tungsten and combinations thereof;

a carbide precipitate-containing region within the substrate and adjacent to a surface of the substrate, and a layer of aluminum coated over at least a portion of the surface of the substrate.

3. The article of claim 2, further including a layer of a noble metal coated over at least a portion of the surface of the substrate.

4. The article of claim 3, further including a layer of aluminum coated over a layer of platinum.

5. The article of claim 2, further including an aluminum-rich diffusion layer extending from the surface of the substrate into the substrate.

6. The article of claim 2, wherein the carbide precipitate-containing region extends to a depth of from about 25 to about 100 micrometers below the surface of the substrate.

7. The article of claim 2 wherein aluminum from the aluminum layer interdiffuses into the substrate to form aluminides to a depth of from about 25 to about 50 micrometers.

8. A superalloy article, comprising:

a nickel-based superalloy substrate susceptible to the formation of a secondary reaction zone during aluminiding treatments, the substrate being depleted of TCP-phase forming elements to a depleted depth below a surface of the substrate; and an aluminum-rich diffusion layer extending from the surface of the substrate to an aluminide depth below the surface of the substrate, the depleted depth being at least as great as the aluminide depth.

9. The article of claim 8, wherein the depleted elements are selected from the group consisting of rhenium, chromium, tantalum and tungsten.

10. A process for preparing a coated article, comprising the steps of:

furnishing a nickel-based superalloy substrate containing rhenium, chromium, tantalum and tungsten;

depositing a carbon-containing layer over a surface of the substrate;

diffusing carbon from the carbon-containing layer into the substrate at a temperature sufficient to form carbide precipitates in the substrate;

depositing an aluminide coating on the surface of the substrate; and heating the substrate to form a protective layer containing aluminum and nickel at the surface of the substrate.

11. The process of claim 10, wherein the step of diffusing is accomplished such that the carbide precipitates extend to a depth below the surface of the substrate at least as great as the depth to which the protective layer containing aluminum and nickel extends below the surface of the substrate.

12. The process of claim 10, wherein the step of depositing a carbon-containing layer is accomplished by chemical vapor deposition from a carbon-containing gaseous phase.

13. The process of claim 10, wherein the carbide precipitates extend to a depth of from about 25 to about 100 micrometers below the surface of the substrate.

14. The process of claim 10, wherein the protective layer extends to a depth of from about 25 to about 50 micrometers below the surface of the substrate.

15. The process of claim 10, including the additional step, after the step of diffusing and before the step of depositing an aluminide coating, of depositing a layer of a noble metal on the surface of the substrate.

16. The process of claim 15 wherein the noble metal is platinum.

17. A coated article prepared by the process of claim 10.

18. A coated article prepared by the process of claim 15.

* * * * *

UNITED STATES PATENT AND TRADEMARK OFFICE

CERTIFICATE OF CORRECTION

PATENT NO. : 5,334,263

DATED : AUGUST 2, 1994

INVENTOR(S) : JON C. SCHAEFFER

It is certified that error appears in the above-identified patent and that said Letters Patent is hereby corrected as shown below:

IN THE DRAWINGS:

Sheet 2, Figure 4, line 4 of the first block, delete "Rh" and insert therefor -- Re--.

Since the preferred embodiment on the cover page was a reproduction of Figure 4, the upper left-hand block on the cover page drawing should be corrected in the same manner.

Signed and Sealed this

Sixth Day of June, 1995

Bruce Lehman

*Attest:*

BRUCE LEHMAN

*Attesting Officer*

*Commissioner of Patents and Trademarks*